US010058201B2

(12) United States Patent
Sparks

(10) Patent No.: US 10,058,201 B2
(45) Date of Patent: Aug. 28, 2018

(54) TABLE TOP FOOD COVER THAT PROTECTS ITEMS ON THE TABLE FROM DEBRIS, BUGS, FLYING INSECTS AND BIRD DROPPINGS

(71) Applicant: Dexter Sparks, Chicago, IL (US)

(72) Inventor: Dexter Sparks, Chicago, IL (US)

( * ) Notice: Subject to any disclaimer, the term of this patent is extended or adjusted under 35 U.S.C. 154(b) by 0 days.

(21) Appl. No.: 14/999,850

(22) Filed: Jul. 11, 2016

(65) Prior Publication Data

US 2018/0008070 A1 Jan. 11, 2018

(51) Int. Cl.

| | |
|---|---|
| ***A47G 19/26*** | (2006.01) |
| ***A47G 23/06*** | (2006.01) |
| ***B65D 45/00*** | (2006.01) |

(52) U.S. Cl.

CPC ..... *A47G 19/26* (2013.01); *A47G 23/06* (2013.01); *B65D 45/00* (2013.01)

(58) Field of Classification Search

CPC ..... A47G 19/26; A47G 23/06; B65D 45/00
USPC ..... 220/7, 6, 324
See application file for complete search history.

(56) References Cited

U.S. PATENT DOCUMENTS

| | | | | |
|---|---|---|---|---|
| 5,111,956 A * | 5/1992 | Jow | A47G 19/26 | 220/811 |
| 6,076,676 A * | 6/2000 | Dahl | B65D 45/18 | 206/467 |
| 2015/0176318 A1* | 6/2015 | Gundersen | E05D 7/12 | 220/324 |

* cited by examiner

*Primary Examiner* — King M Chu

(57) ABSTRACT

A table top food cover made of three plastic or metal parts, and two clamps that collapse into the rear tray of the unit for easy storage. The unit is design to cover food trays, plates and pans to protect the food from the element, both indoors and outdoors. By lifting the front panel of the unit you can serve yourself and lower the panel to protect the food from debris or bugs.

1 Claim, 2 Drawing Sheets

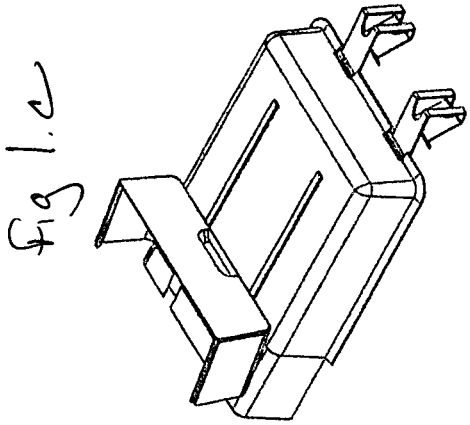
Fig 1.C
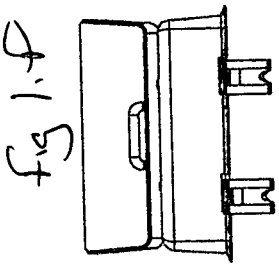
Fig 1.F
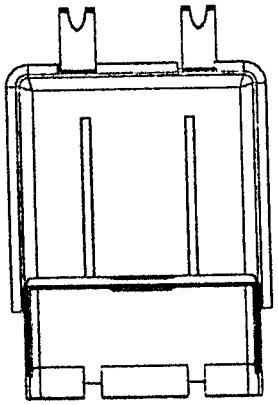
Fig 1.B
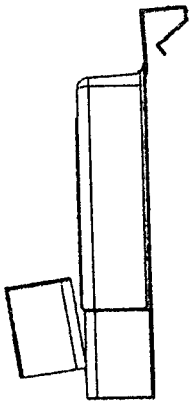
Fig 1.E
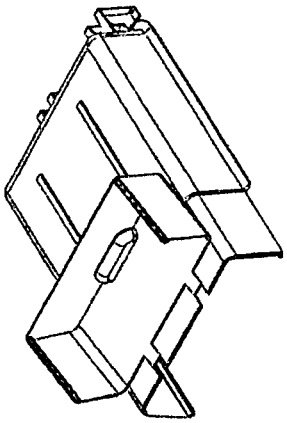
Fig 1.A
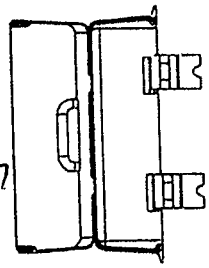
Fig 1.D

TABLE TOP FOOD COVER THAT PROTECTS ITEMS ON THE TABLE FROM DEBRIS, BUGS, FLYING INSECTS AND BIRD DROPPINGS

FIELD OF INVENTION

1) The invention pertain to keeping food safe from the outside elements. When food is served outdoors, or in large crowds of people. It is design to protect food from flying debris, bugs, inadvert items drop by individuals. And bird dropping. It also eliminate the traditional foil used to cover food trays. That can save you money, and you don't have to chase the foil in the park when it blows away. Or individuals not placing the foil back in a secure position on the tray.

BACK GROUND OF INVENTION

2) As a person that loved the outdoors, picnics family reunions, the beach or just have fun in your back yard it's always on my mind about keeping the food and utensils safe from any objects that can harm or make someone sick the unit can be of plastic or metal. At the time the food is prepaired the cook places the food in a pan before serving. The food cover can keep it safe from bugs until the food is served. With millions of people enjoying the outdoors and ever changing ways we interact with each other it's the best way to ensure the food products we eat are safe from any items or germs that can cause us harm.

DESCRIPTION OF INVENTION

The invention is a food cover design to protect food from outside elements. It's a four part collapseable unit made of plastic or metal with two clamps on the rear of the unit to stabilize the unit to the table. The twenty four inch unit will cover a standard foil serving tray with the front part design to swing up to access the food in the tray. Or collapse to a smaller size to cover a smaller tray or plate, bread, buns or chips. Without the foil that traditionally is used to cover the standard foil tray.

Figure 1:
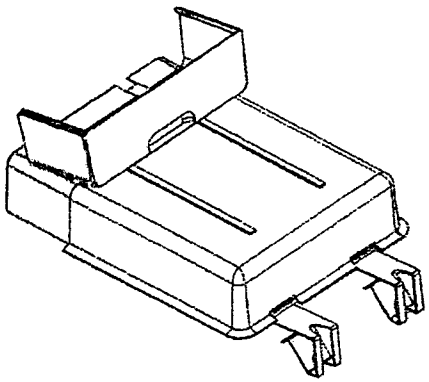
FIG. 1

Perspective is a view from the three sides, top view, side view, and rear view. The top side view shows that most important parts of the unit. The front lid to access the food. The middle chamber to collapse, to change the size. And the rear two clamps the attach to the table for stability.

The invention claimed is:

1. A food cover configure to protect food from outside elements, the food cover comprising of a four part collapsible unit, whereas the four parts has a, front panel, middle panel, rear panel, and clamps made of plastic or metal, the rear panel accommodate smaller trays, the middle panel slides into the rear panel for storage, and the front panel configure to swing open to access the interior of the unit, with two clamps on the rear panel configure to help stabilize the unit.

* * * * *